US006152748A

United States Patent [19]

Sato et al.

[11] Patent Number: 6,152,748

[45] Date of Patent: Nov. 28, 2000

[54] CARD EJECTION DEVICE AND A CARD CONNECTOR USING THE SAME

[75] Inventors: Takeshi Sato; Kinzo Narumo, both of Tokyo, Japan

[73] Assignee: Honda Tsushin Kogyo Co., Ltd., Tokyo, Japan

[21] Appl. No.: 09/233,165

[22] Filed: Jan. 19, 1999

[30] Foreign Application Priority Data

Oct. 19, 1998 [JP] Japan ..... 10-296602

[51] Int. Cl.[7] ..... H01R 13/62

[52] U.S. Cl. ..... 439/159

[58] Field of Search ..... 439/159, 157, 439/160

[56] References Cited

U.S. PATENT DOCUMENTS 5,443,395 8/1995 Wang ..... 439/159
5,707,245 1/1998 Yamamoto et al. ..... 439/160
5,795,190 8/1998 Ono ..... 439/607
6,000,958 12/1999 Ishida et al. ..... 439/159

*Primary Examiner*—Neil Abrams
*Assistant Examiner*—Amir Abdulmelik
*Attorney, Agent, or Firm*—Arent Fox Kintner Plotkin & Kahn, PLLC

[57] ABSTRACT

Disclosed is an improvement in a card ejection device having an ejection lever slidably attached to one side of an associated card casing so that the inserting of a card in the card casing may drive the ejection lever out of the front side of the card casing, and so that the pushing of the ejection lever toward the rear side of the card casing may eject the card out of the front side of the card casing. The head section of the ejection lever has two opposite walls that are "U" shaped, rotatably sandwiching an ejection button. The pivot axle of the ejection button passes through the engagement holes made in the confronting walls, thereby permitting the ejection button to turn from the operative position in which the ejection button is put in alignment with the ejection lever to the rest position in which the ejection lever is perpendicular to the ejection lever or vice versa.

3 Claims, 5 Drawing Sheets

CARD EJECTION DEVICE AND A CARD CONNECTOR USING THE SAME

BACKGROUND OF THE INVENTION

1. Field of the Invention

The present invention relates to a card ejection device and to a card connector using the same, such as a card connector for memory cards, PC cards, compact flash cards or cards which may be used in notebook-sized personal computers or portable terminal devices.

2. Description of Related Art

As shown in FIG. 7, a conventional card ejection device comprises a rectangular casing 2 of synthetic resin for holding two cards at upper and lower stages, two rotary levers 3 pivoted with a pin 8 to the rear side of the casing 2, two ejection levers 4 slidably attached to one side of the casing 2 with their rear ends loosely connected to one ends of the rotary levers 3, and with their front ends press-fitted in first buttons 5 of synthetic resin, which are pivoted to second buttons 6 of synthetic resin to permit the second buttons 6 to turn 90 degrees relative to the first buttons 5.

As seen from FIG. 8, a card 1 is inserted in a selected compartment of the casing 2 as indicated by arrow in FIG. 8, and then, as shown in FIG. 9(A), as the rotary lever 3 is pushed by the card 1, it is made to turn about the pin 8, so that the ejection lever 4 is moved in the direction opposite to the direction in which the card 1 is inserted.

Thus, the first and second buttons 5 and 6 are pushed out until the second button 6 appears beyond the front edge of the casing 7, as seen from FIG. 9(A). Then, the second button 6 is made to turn 90 degrees relative to the first button 5 so that the second button 6 may be flush with the front edge of the casing 7, as seen from FIG. 9(B).

The card ejection device has two buttons 5 and 6 of synthetic resin attached to the ejection lever 4 of metal, and use of two different buttons 5 and 6 increases the number of assembling steps and the manufacturing cost. Also, disadvantageously when the second button 6 is pushed and integrally combined with the first button 5, the second button 6 is unstable and shaky relative to the first button 5, thus making it somewhat difficult to effect ejection of the card 1 from the casing with the aid of the second button 6. When the second button 6 turns 90 degrees for rest position, it cannot stay in stable condition because of lack of means for positively holding the second button 6 at correct position.

SUMMARY OF THE INVENTION

In view of the above one object of the present invention is to provide a card ejection device which is free of such defects as described above.

To attain this object a card ejection device having an ejection lever slidably attached to one side of an associated card casing so that the inserting of a card in the card casing may cause the ejection lever to be pushed toward the front side of the card casing, and so that the pushing of the ejection lever toward the rear side of the card casing may cause the card to be ejected from the front side of the card casing, is improved according to the present invention in that the head section of the ejection lever has two opposite walls are u shaped, rotatably sandwiching an ejection button, the pivot axle of which passes through the engagement holes made in the confronting walls, thereby permitting the ejection button to turn from the operative position in which the ejection button is put in alignment with the ejection lever to the rest position in which the ejection lever is perpendicular to the ejection lever and vice versa.

Use of the "U"-shaped walls has the effect of increasing the strength of the ejection lever, and use of a single ejection button has the effect of reducing the number of parts to be assembled, and accordingly the manufacturing cost.

The inner surfaces of the opposite walls and the outer surfaces of the ejection button may have projections and counter recesses formed therein, thereby permitting the ejection button to click when turning from the operative position to the rest position and vice versa. The opposite walls may have cantilever-like stoppers cut-and-inward bent therefrom, thereby permitting the ejection lever to stop and stay at the rest position. The ejection lever and ejection button may have male-and-female locking means formed therein, the male-and-female locking means being responsive to the aligning-and-pushing of the ejection button in the operative position for fastening the ejection button to the ejection lever, thereby putting the ejection button in the stable operative position.

With these arrangements the ejection button can stay stable at correct position, and the operator can be informed of arrival at correct position with a snap.

A card connector for detachably holding a card for inputting and outputting pieces of electric information, is equipped with a card ejection device as described above.

Other objects and advantages of the present invention will be understood from the following description of a card ejection lever according to one embodiment of the present invention, which is shown in accompanying drawings:

BRIEF DESCRIPTION OF THE DRAWINGS

FIG. 9 illustrates how the conventional card connector can be used: particularly

DESCRIPTION OF THE PREFERRED EMBODIMENTS

Figure 7A:
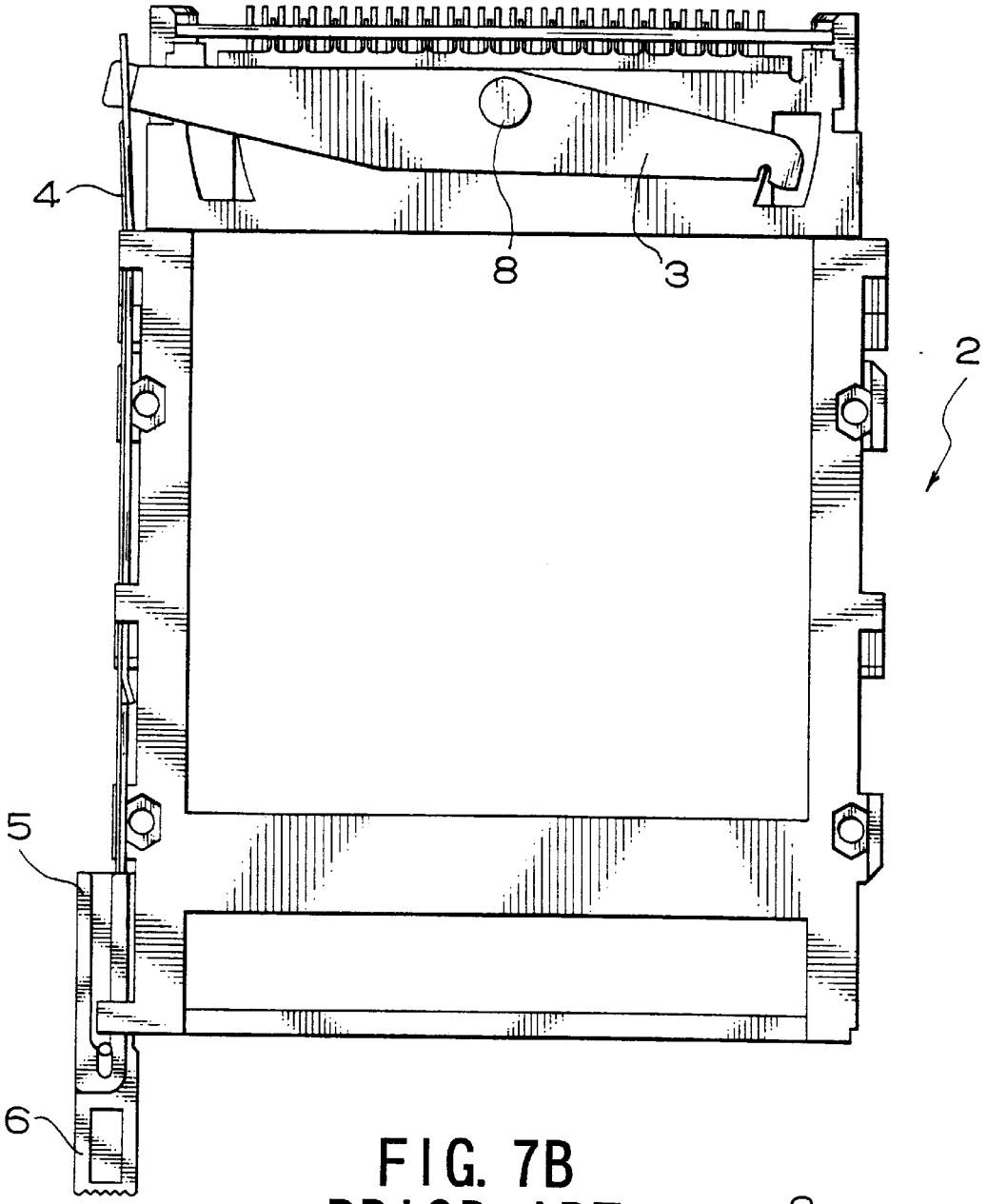
FIG. 7A PRIOR ART
FIG. 7A is a plane view of a conventional card connector.
Figure 7B:
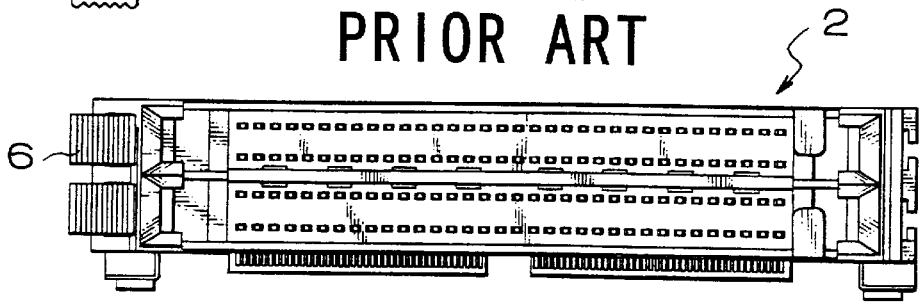
FIG. 7B PRIOR ART
FIG. 7B is a rear view of the conventional card connector.
Figure 8:
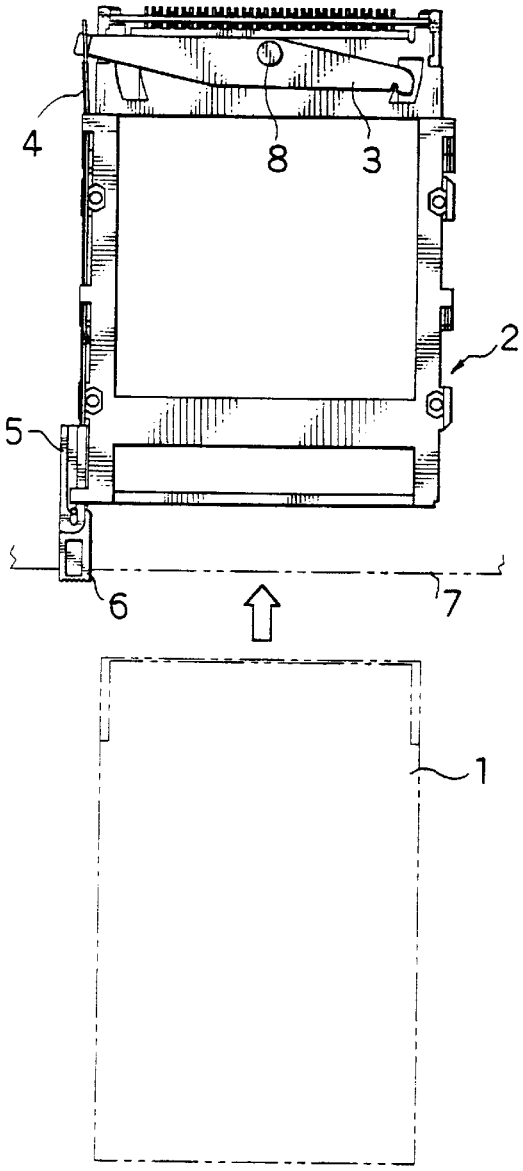
FIG. 8 PRIOR ART
FIG. 8 illustrates how a card can be inserted in the conventional card connector.
Figure 9A:
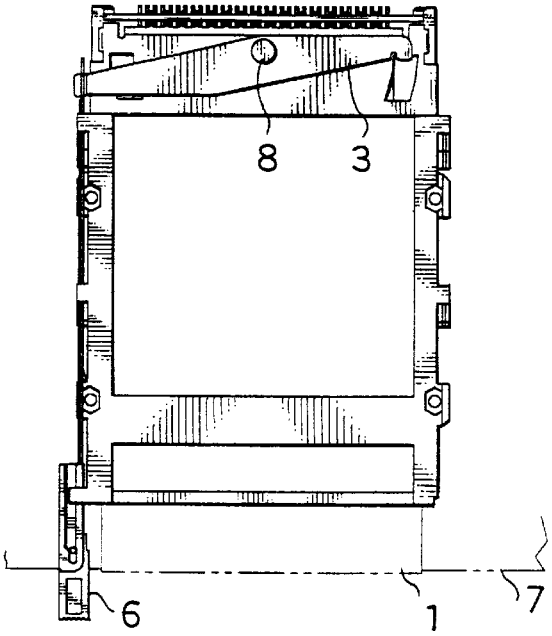
FIG. 9A PRIOR ART
FIG. 9A shows the conventional card connector as having a card inserted therein.
Figure 9B:
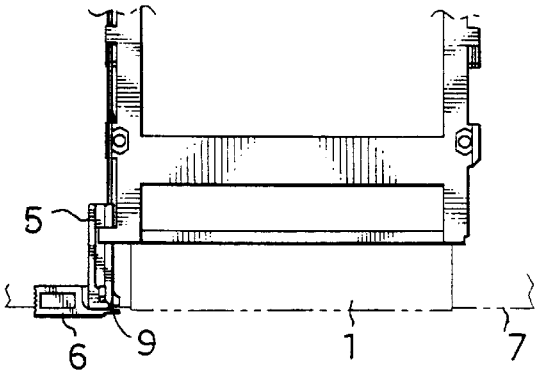
FIG. 9B PRIOR ART
FIG. 9B shows the conventional card connector as having its second button folded aside.

A card ejection device according to one embodiment of the present invention is described with reference to FIGS. 1 to 6. In these drawings same parts as used the conventional card ejection device are indicated by same reference numerals as used in FIGS. 7 to 9 to facilitate the understanding of the card ejection device according to the present invention.

Figure 1:
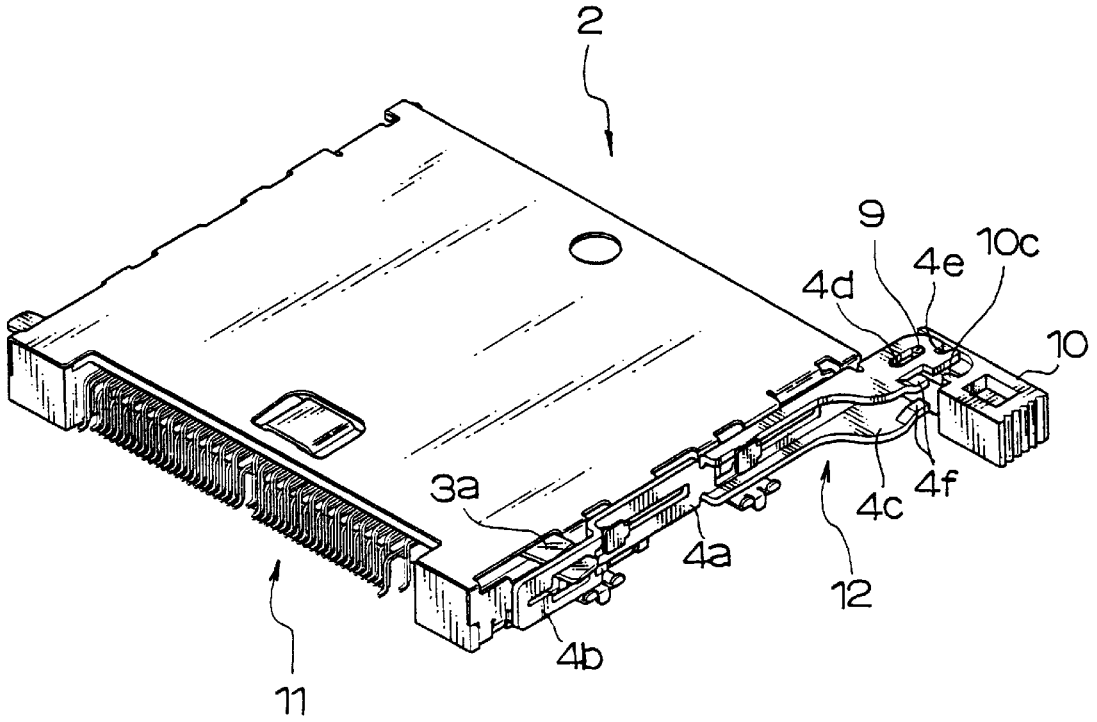
FIG. 1 is a perspective view of a card connector equipped with a card ejection device according to the present invention.

Referring to FIG. 1, the card ejection device 11 comprises a rectangular card casing 2 both of synthetic resin and metal for accommodating a card 1, a plurality of contacts appearing on the rear side of the rectangular card casing 2 to be soldered to selected conductors of a printed, circuit board, and a metal ejection lever 4*a* slidably attached to one side of the card casing 2. The rear end 4*b* of the ejection lever 4*a* is loosely connected to one end 3*a* of the rotary lever 3, and an ejection button 10 is rotatably connected to the front end of the ejection lever 4*a*. The ejection lever 4*a* can be moved back and forth as indicated by double-headed arrow in FIG. 1, and the ejection button 10 can be put selectively in the operative position in which the ejection button 10 is in alignment with the ejection lever 4*a* or in the rest position in which the ejection button 10 is perpendicular to the ejection lever 4*a*. The inserting of the card 1 in the card casing 2 drives the ejection lever 4*a* out of the front side of the card casing 2, and the pushing of the ejection lever 4*a* toward the rear side of the card casing 2 ejects the card 1 out of the front side of the card casing 2, as is the case with the conventional card ejection device.

The head section 4*c* of the ejection lever 4*a* has two opposite walls formed in the letter of "U", thereby increasing the longitudinal strength of the ejection lever 4*a*.

Figure 2:
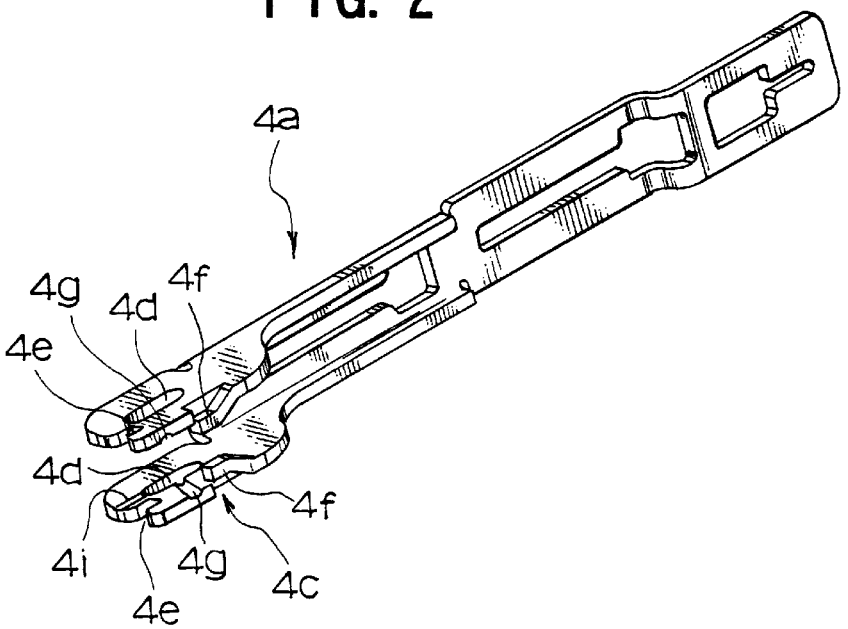
FIG. 2 is a perspective view of the ejection lever of the card ejection device.

As seen from FIG. 2, the opposite reinforcement walls have elongated engagement holes 4*d* made therein, and the reinforcement walls rotatably sandwich the ejection button 10 by passing a pivot pin 9 through the hole 9 of the ejection button 10 and the elongated engagement holes 4*d* of the confronting walls, permitting the ejection button 10 to turn from the operative position to the rest position or vice versa.

Each reinforcement wall has a notch 4*e* made on its curved front surface for the purpose of assuring the stable alignment of the ejection button 10 relative to the ejection lever 4*a,* as later described.

Also, each reinforcement wall has a longitudinal cut-and-inward bent projection formed on its intermediate top as a cantilever-like stopper 4*f* to prevent the ejection button 10 from turning beyond the perpendicular rest position. In addition, each reinforcement wall has two narrow recesses 4*g* and 4*i* made on its front, inner surface at quadrate positions. These narrow recesses 4*g* and 4*i* are adapted to accommodate the counter semicylindrical snap projections 10*b* of the ejection button 10 with a snap when turning from the operative position to the rest position or vice versa.

Figure 3:
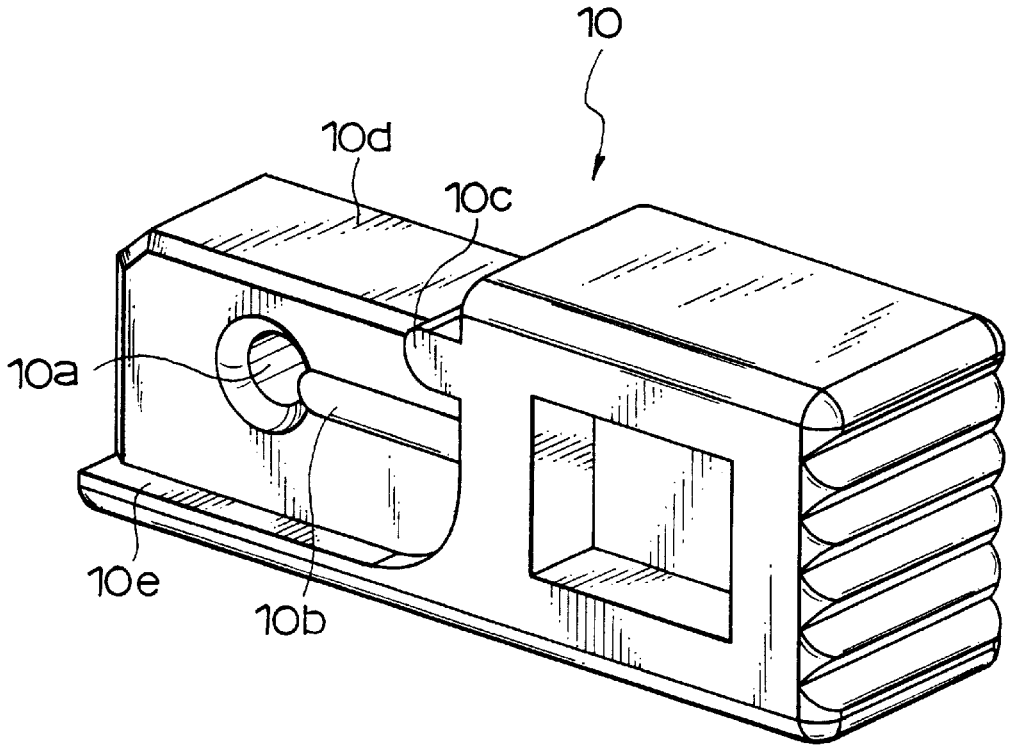
FIG. 3 is a perspective view of the ejection button.
Figure 4:
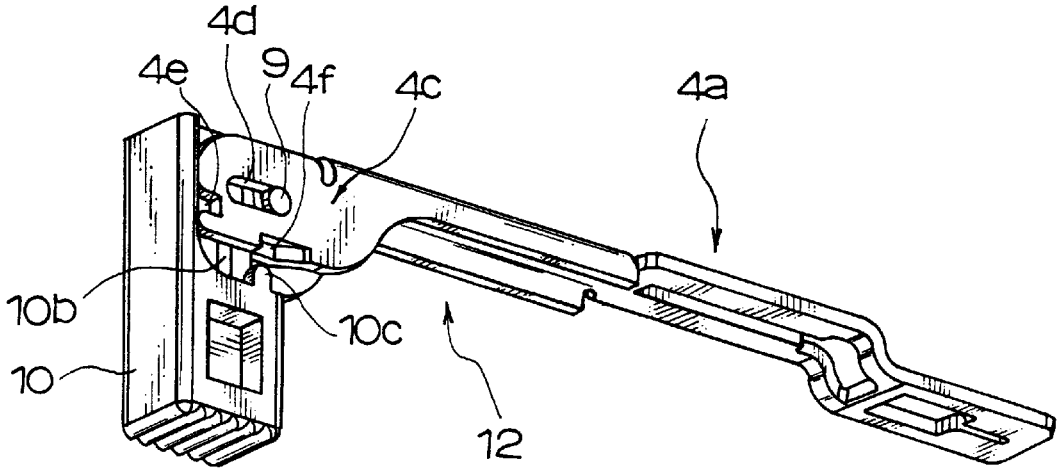
FIG. 4 is a perspective view of the card ejection device.

Referring to FIG. 3, the ejection button 10 is a rectangular solid body made of synthetic resin, the upper half of which can be held by fingers. The remaining lower half has a somewhat reduced lateral size to leave longitudinal flanges 10*e* on its rear, opposite sides. It has a through hole 10*a* for passing a pivot pin 9 therethrough, semicylindrical snap projections 10*b* formed on its opposite sides, and a sway-proof projection 10*c* formed on the lower-to-upper transition.

The ejection button 10 will abut on the cantilever-like stoppers 4*f* of the ejection lever 4*a* when the ejection button 10 is turned to the rest position, and its longitudinal flanges 10*e* will be caught by the front edges of opposite reinforcement walls 4*c* (see FIG. 4), thus being prevented from turning to the operative or alignment position.

The metal ejection lever 4*a* and the ejection button 10 are assembled by press-fitting the lower half of the ejection button 10 between the opposite reinforcement walls of the ejection lever 4*a* and by rotatably fixing the ejection button 10 to the confronting reinforcement walls with a pin axle 9 passing through the elongated holes 4*d* and the through hole 10*a,* thus providing an ejection device 12 according to the present invention.

Figure 5:
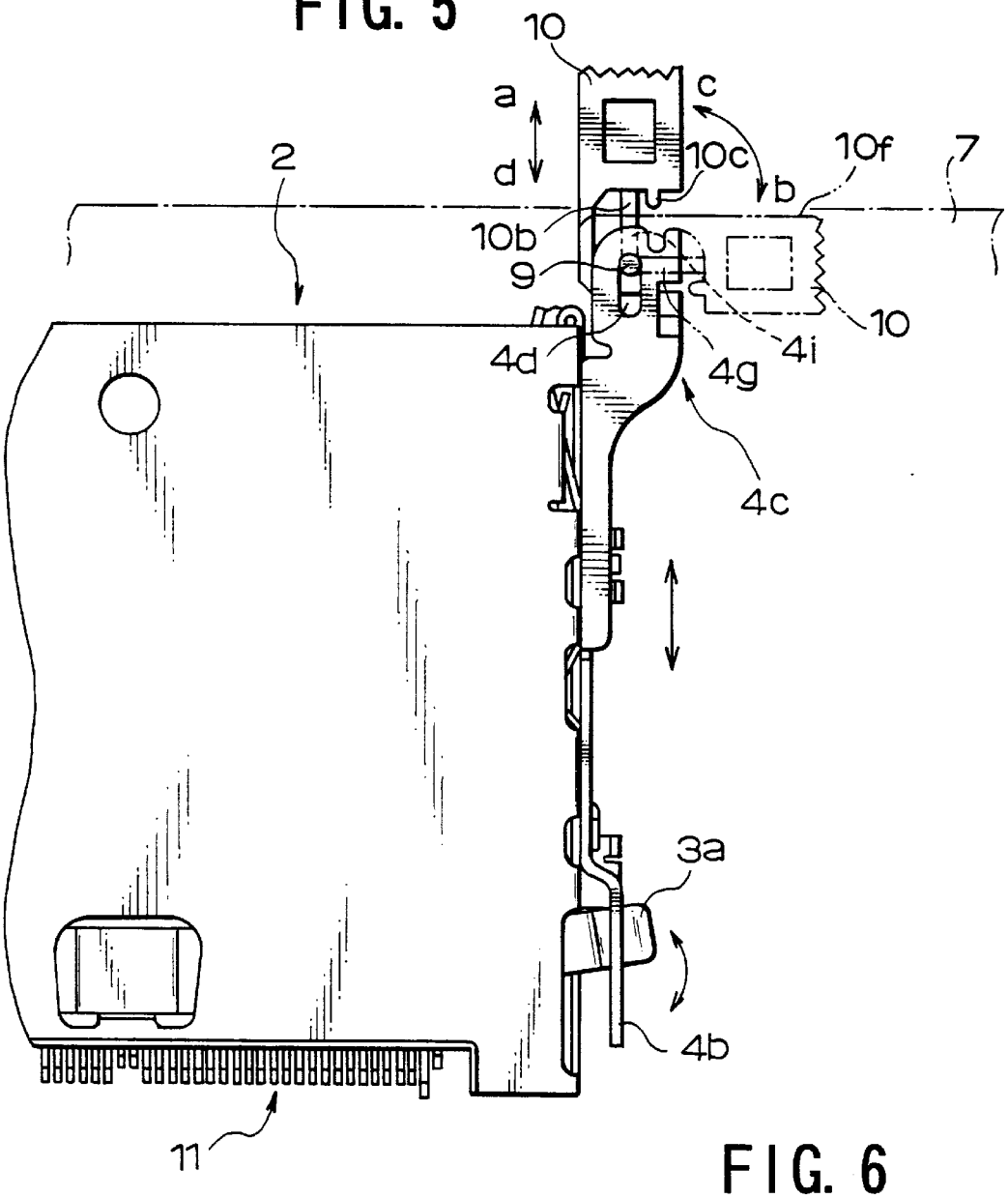
FIG. 5 illustrates how the card ejection device can be put in operative condition.

Referring to FIG. 5, a card is inserted from the front card inlet of the card casing 2 to rotate the rotary lever 3, so that the rear end 4*b* of the ejection lever 4*a* may move forward until the ejection button 10 appears beyond the front side of the card casing 2.

Then, the ejection button 10 is pulled in the direction indicated by arrow "a", allowing the pivot pin 9 to move in the elongated holes 4*d* in the same direction, and allowing the counter sway-proof projection 10*c* to leave the notches 4*e* (in solid lines). The ejection button 10 is rotated in the direction indicated by arrow "b," to be put in the rest position (in broken lines) with a snap as the semicylindrical snap projections 10*b* of the ejection button 10 fit in the counter recesses 4*g* of the opposite reinforcement walls 4*c*.

In the rest position the ejection button 10 is laid with its inner side 10*f* flush with the front edge 7 of the card casing 2, causing no hindrance to the outside.

Figure 6:
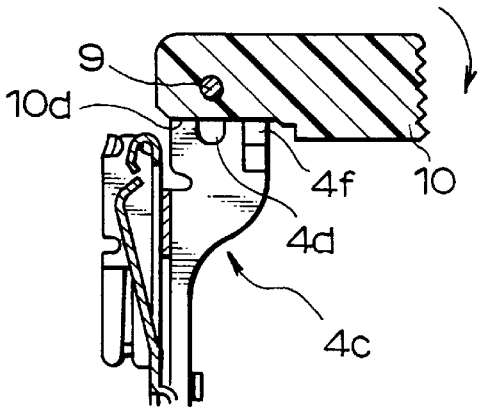
FIG. 6 illustrates how the ejection button is in perpendicular, rest position.

As seen from FIG. 6, the ejection button 10 is retained correctly in the rest position as the cantilever-like stoppers 4*f* abut on the ejection button 10 as indicated at 10*d*.

In removing the card 1 from the card casing 2 the ejection button 10 is raised in the direction indicated by the arrow "c" to be put in alignment with the ejection lever 4*a* (see FIG. 5, solid lines) with a snap as the semicylindrical snap projections 10*b* fall in the counter recesses 4*i*.

Then, the ejection button 10 is pushed in the direction indicated by arrow "d", allowing the pivot pin 9 to move in the elongated holes 4*d* in the same direction until the sway-proof projection 10*c* to fit in the recesses 4*e* of the opposite reinforcement walls 4*c*. Thus, the ejection button 10 is put in stable position in alignment with the ejection lever 4*a*.

Further push of the ejection button 10 in the direction "d" causes the ejection lever 4*a* to rotate the rotary lever 3 through the agency of the loose joint between the rear end 4*b* of the ejection lever 4*a* and the rear end 3*a* of the rotary lever 3. The card is ejected from the card casing 2 under the influence of leverage provided by the rotary lever 3 thus turned.

The card ejection device can be modified within the spirit of the present invention, and such modifications which are obvious to those skilled in the art will fall in the scope of the invention as defined in the following claims.

What is claimed is:

1. A card ejection device for a card connector comprising an ejection lever slidably attached to one side of an associated casing for a card and having a U-shaped head section with a slot and a cantilever like stopper formed in each of opposing walls and a tail section with a slot, through which one end of a rotary lever in the card connector projects, an ejection button with a through hole, and a pin arranged to pass through the slots of said ejection lever and the through hole of said ejection button, for pivotally connecting said ejection button to the head section of said ejection lever, thereby permitting said ejection button to turn from its operating position, in which said ejection button aligns with said ejection lever, to its rest position, in which said ejection button makes a right angle with said ejection lever and a projection formed in said ejection button abuts to the cantilever like stopper formed in the head section of said ejection lever, or vice versa.

2. The card ejection device according to claim 1, wherein said ejection button has a semicylindrical projection and said ejection lever has a recess in each of the opposing walls to accommodate the semicylindrical projection of said ejection button, when said ejection button is in the rest potion.

3. The card ejection device according to claim 1, wherein said ejection lever has a notch in each of the opposing walls and said ejection button has a projection which takes a position opposing to the notices of said ejection lever, when said ejection button is in the operative position, and the notches accommodate the projection, when said ejection button is pushed, prior to actual sliding movement of said ejection lever to be caused by continuous pushing of said ejection button, which causes movement of the rotary lever to ejection the card from the casing of the card connector.

* * * * *